US008462074B2

(12) United States Patent
Lai et al.

(10) Patent No.: US 8,462,074 B2
(45) Date of Patent: Jun. 11, 2013

(54) PLANAR ANTENNA AND WIRELESS COMMUNICATION APPARATUS

(75) Inventors: Ming-Iu Lai, Taipei (TW); Hung-Hsiang Chen, Taipei (TW); Yang-Po Chiu, Taipei (TW); Chun-Hsiung Wang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 662 days.

(21) Appl. No.: 12/481,584

(22) Filed: Jun. 10, 2009

(65) Prior Publication Data

US 2010/0045540 A1 Feb. 25, 2010

(30) Foreign Application Priority Data

Aug. 20, 2008 (TW) ..... 97131819 A

(51) Int. Cl.
*H01Q 1/38* (2006.01)
*H01Q 1/24* (2006.01)

(52) U.S. Cl.
USPC ..... 343/862; 343/700 MS; 343/702

(58) Field of Classification Search
USPC ..... 343/700 MS, 702, 850, 852, 853, 343/860, 862, 863, 864; 333/124, 125, 245, 333/246
See application file for complete search history.

(56) References Cited

U.S. PATENT DOCUMENTS

| | | | | |
|---|---|---|---|---|
| 6,002,367 | A | 12/1999 | Engblom et al. | |
| 6,531,985 | B1 | 3/2003 | Jones et al. | |
| 6,788,266 | B2 * | 9/2004 | St. Hillaire et al. | 343/770 |
| 7,012,570 | B2 * | 3/2006 | Chen et al. | 343/700 MS |
| 7,242,353 | B2 | 7/2007 | Hung et al. | |
| 7,436,361 | B1 * | 10/2008 | Paulsen et al. | 343/700 MS |
| 7,554,488 | B2 * | 6/2009 | Mei et al. | 343/700 MS |
| 2007/0115188 | A1 * | 5/2007 | Mizoguchi et al. | 343/702 |
| 2007/0188388 | A1 * | 8/2007 | Feng et al. | 343/700 MS |
| 2007/0241971 | A1 * | 10/2007 | Tsujimura et al. | 343/702 |

FOREIGN PATENT DOCUMENTS

WO WO2008046193 A1 * 4/2008

* cited by examiner

*Primary Examiner* — Robert Karacsony
(74) *Attorney, Agent, or Firm* — Jianq Chyun IP Office

(57) ABSTRACT

A planar antenna disposed on a plate having a first surface and a second surface is provided. The planar antenna includes a metal layer, an antenna body, a stepped impedance device, a coupling device and a matching device. The metal layer is disposed on the first surface and has a slot line exposing the first surface. The antenna body, the stepped impedance device, the coupling device and the matching device are disposed on the second surface. The antenna body is corresponding to a surrounding of the metal layer except a feed end thereof, the stepped impedance device and the matching device are corresponding to the metal layer, and the coupling device is corresponding to the slot line. The matching device is coupled between the coupling device and the feed end. The stepped impedance device has a transmission zero in a radio frequency band operated by the antenna body.

18 Claims, 10 Drawing Sheets

PLANAR ANTENNA AND WIRELESS COMMUNICATION APPARATUS

CROSS-REFERENCE TO RELATED APPLICATION

This application claims the priority benefit of Taiwan application serial no. 97131819, filed Aug. 20, 2008. The entirety of the above-mentioned patent application is hereby incorporated by reference herein and made a part of specification.

BACKGROUND OF THE INVENTION

1. Field of the Invention

The present invention relates to a planar antenna and a wireless communication apparatus. More particularly, the present invention relates to a planar antenna without a through-hole structure and a wireless communication apparatus 2. Description of Related Art With development of hardware device and technique for wireless transmission, a multi input multi output (MIMO) technique has become an important indicator for a high efficiency wireless communication technique, and gradually becomes a main stream for future wireless communication. Different to a conventional design of a single antenna, the MIMO technique applies multi antennas to achieve multi-path transmission of a wireless network. Moreover, the MIMO technique has advantages of improving a transmission speed and a signal-receiving range of the wireless network, etc.

In the wireless network mainly applying the MIMO technique, the wireless communication apparatus has to apply a plurality of antennas to implement the multi-path transmission mechanism. For example, assuming a wireless local area network (WLAN) applies a 3×3 MIMO system, and a worldwide interoperability for microwave access (WiMAX) applies a 2×2 MIMO system, the wireless communication apparatus then has to utilize 5 antennas for being applied to the WLAN and WiMAX.

However, a cost of a single antenna is about 20-30 NT presently, so that 100-150 NT have to be spent for the antenna cost of the wireless communication apparatus. Moreover, as a number of the inbuilt antenna increases, a system manufacture has to spend more human labours and time for assembling the antennas. In other words, when a plurality of antenna is applied to the wireless communication apparatus, the antenna size, the material cost and the labour cost for assembling are greatly increased.

SUMMARY OF THE INVENTION

The present invention is directed to a planar antenna, which can apply a stepped impedance device to substitute a through-hole structure, and can be directly printed on a plate.

The present invention is directed to a wireless communication apparatus, in which a material cost and a labour cost for assembling is not greatly increased as a number of inbuilt planar antennas increases.

The present invention provides a planar antenna disposed on a plate, wherein the plate has a first surface and a second surface. The planar antenna includes a metal layer, an antenna body, a stepped impedance device, a coupling device and a matching device. The metal layer is disposed on the first surface and has a slot line for exposing the first surface.

The antenna body is disposed on the second surface, and has a ground end and a feed end. Moreover, the antenna body is corresponding to a surrounding of the metal layer except a partial area of the feed end thereof. The coupling device is disposed on the second surface, and a partial area of the coupling device is corresponding to the slot line of the metal layer. The matching device is disposed on the second surface in an approach of corresponding to the metal layer, and is electrically connected to the coupling device and the feed end. Wherein, the matching device is used for impedance matching between the antenna body and the coupling device. In addition, the stepped impedance device is disposed on the second surface in an approach of corresponding to the metal layer, and is electrically connected to the ground end of the antenna body.

On the other hand, in a whole operation, when the stepped impedance device is operated in a radio frequency band, it can have a transmission zero and is regarded as an open circuit. Accordingly, the antenna body can generate a resonance mode in such radio frequency band, and can receive or emit signals of such radio frequency band. Moreover, the signal received by the antenna body can be coupled to a lead wire crossing the slot line through the coupling device.

In an embodiment of the present invention, the radio frequency band is used for transmitting a signal having a first wavelength, and the stepped impedance device includes a first impedance wire and a second impedance wire. Wherein, the first impedance wire has a first impedance $Z_1$, and a distance between two ends thereof is $D_1$. The second impedance wire has a second impedance $Z_2$, and a distance between two ends thereof is $D_2$. Moreover, one end of the second impedance wire is electrically connected to the first impedance wire, and another end of the second impedance wire is electrically connected to the ground end of the antenna body.

It should be noted that when $\lambda_1$ is the first wavelength, $\theta_1$ is a first phase angle, and r is a positive number, the aforementioned $D_1$, $D_2$, $Z_1$ and $Z_2$ are in accord with following equations: $\tan\theta_1 \times \tan(r\cdot\theta_1)=Z_1/Z_2$, $D_1=(\theta_1\times\lambda_1)/360$ and $D_2=r\times D_1$.

In an embodiment of the present invention, the coupling device includes a first coupling wire and a second coupling wire. Wherein, the first coupling wire is directly or indirectly connected to the feed end of the antenna body, electrically, and a position of the first coupling wire is corresponding to the slot line. Moreover, the second coupling wire is electrically connected to the first coupling wire.

In an embodiment of the present invention, the slot line includes a linear opening, a first opening and a second opening. Wherein, the linear opening, the first opening and the second opening penetrate the metal layer to expose the first surface. Moreover, the first opening is communicated to a side of the linear opening, and the second opening is communicated to another side of the linear opening.

The present invention further provides a wireless communication apparatus including a first plate, a second plate and a plurality of planar antennas, wherein the first plate has a first surface and a second surface. The second plate and the first plate form a chamber to contain an inner circuit of the wireless communication apparatus. Moreover, the planar antennas are all disposed on the first plate, and a structure of each of the planar antennas is the same to that of the aforementioned planar antenna.

In an embodiment of the present invention, the first surface is a part of inner wall of the chamber. Moreover, the wireless communication apparatus further includes a display panel and an insulation layer, wherein the display panel is disposed in the chamber, and a position thereof is fixed between the metal layer and a transparent block of the second plate. The insulation layer covers the antenna body, the stepped impedance device and the coupling device.

In the present invention, the stepped impedance device is used for substituting a through-hole structure in a conventional planar antenna. Moreover, the coupling device is used for coupling the signal received by the planar antenna to the lead wire crossing the slot line of the metal layer. Therefore, compared to the conventional technique, the planar antenna of the present invention can be directly printed on the plate, so that a material cost and a labour cost for assembling can be effectively reduced. Comparatively, the wireless communication apparatus can implement the multi-path transmission mechanism by applying the planar antenna of the present invention, so as to restrain a great increase of the material cost and the labour cost for assembling.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
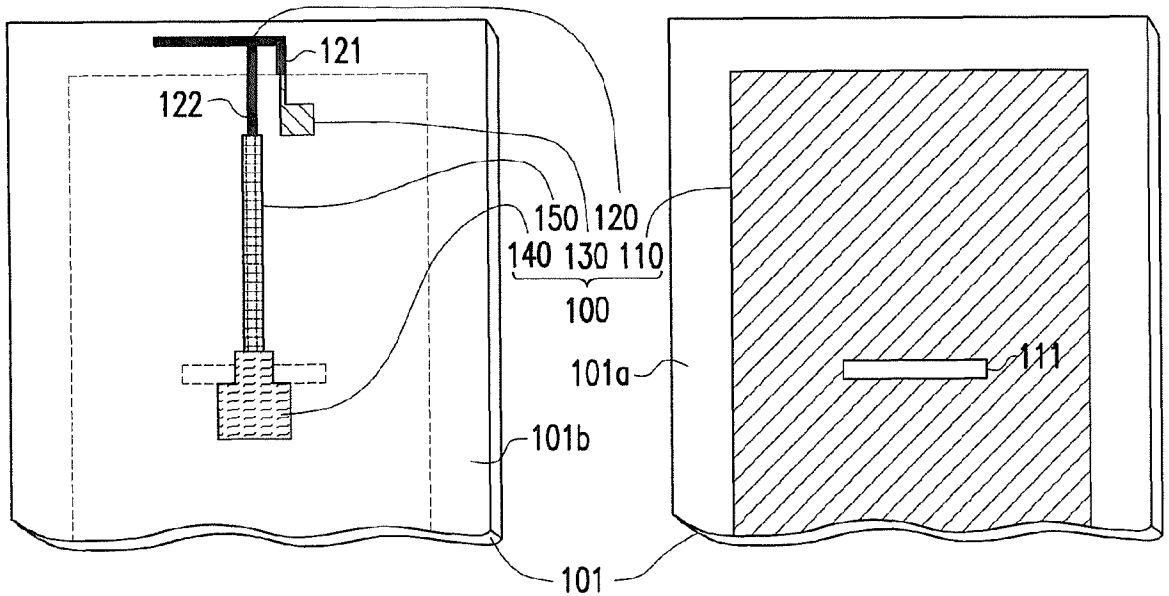
FIG. 1 is a schematic diagram illustrating a structure of a planar antenna according to an embodiment of the present invention.

FIG. 1 is a schematic diagram illustrating a structure of a planar antenna according to an embodiment of the present invention. The planar antenna 100 is disposed on a plate 101, and the plate 101 has a first surface 101*a* and a second surface 101*b*.

It should be noted that in the present embodiment, the plate 101 can be a printed circuit board (PCB), and the first surface 101*a* is parallel to the second surface 101*b*. However, those skilled in the art can also apply the planar antenna 100 to any plate having two surfaces according to actual design requirements. In other words, though the present embodiment provides a possible pattern of the plate 101, it is not used for limiting the present invention.

Referring to FIG. 1 again, the planar antenna 100 includes a metal layer 110, an antenna body 120, a stepped impedance device 130, a coupling device 140 and a matching device 150. Wherein, the metal layer 110 is disposed on the first surface 101*a* and has a slot line 111 for exposing the first surface 101*a*. On the other hand, the antenna body 120, the stepped impedance device 130, the coupling device 140 and the matching device 150 are all disposed on the second surface 101*b* according to a position of the metal layer 110.

For simplicity's sake, a corresponding position of the metal layer 110 on the second surface 101*b* is illustrated by dash lines. Referring to FIG. 1, the antenna body 120 is disposed on the second surface 101*b*, and has a ground end 121 and a feed end 122. It should be noted that except a partial area of the feed end 122, the antenna body 120 is disposed on the second surface 101*b* in an approach of corresponding to a surrounding of the metal layer 110. Moreover, the stepped impedance device 130 is disposed on the second surface 101*b* in an approach of corresponding to the metal layer 110, and is electrically connected to the ground end 121 of the antenna body 120.

Moreover, the coupling device 140 is disposed on the second surface 101*b*, and a partial area of the coupling device 140 is disposed on the second surface 101*b* in an approach of corresponding to the slot line 111 of the metal layer 110. On the other hand, the matching device 150 is disposed on the second surface 101*b* in an approach of corresponding to the metal layer 110, and is electrically connected to the coupling device 140 and the feed end 122 of the antenna body 120. Here, the matching device 150 is used for impedance matching between the antenna body 120 and the coupling device 140.

In a whole operation, when the stepped impedance device 130 is operated in a certain radio frequency band, it can generate a transmission zero and is regarded as an open circuit. Accordingly, the antenna body 120 can generate a resonance mode in the above-mentioned radio frequency band, and can receive or emit signals in the above-mentioned radio frequency band. Moreover, the signal received by the antenna body 120 can be guided to a coaxial wire through the coupling device 140.

Figure 3:
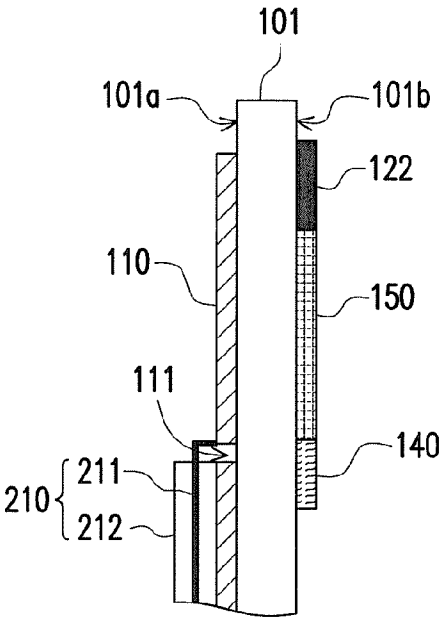
FIG. 3 is a cross-sectional view of FIG. 2 cut along a A-A' line.
Figure 2:
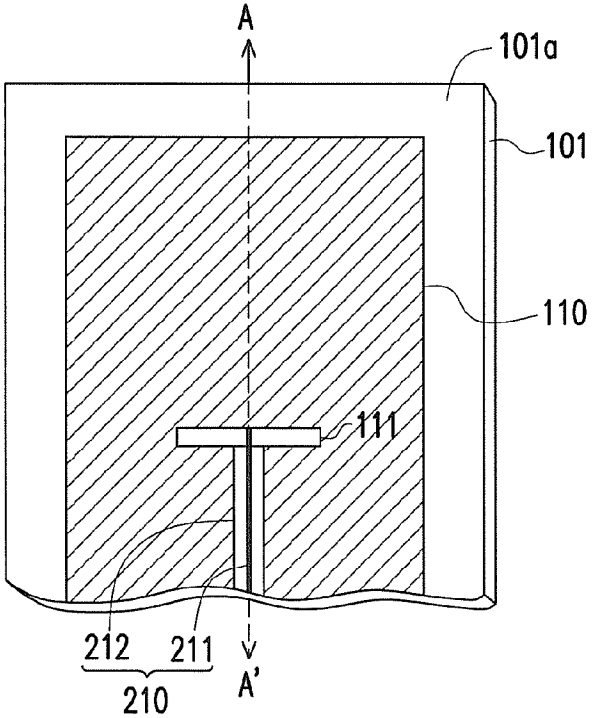
FIG. 2 is a diagram illustrating a configuration of a coaxial wire 210 on a plate 101.

For example, the planar antenna 100 further includes a coaxial wire 210. FIG. 2 is a diagram illustrating a configuration of the coaxial wire 210 on the plate 101, and FIG. 3 is a cross-sectional view of FIG. 2 along a A-A' line. Referring to FIG. 2 and FIG. 3, if the signal received by the antenna body 120 is transmitted through the coaxial wire 210, an outer conductor 212 of the coaxial wire 210 is electrically connected to the metal layer 110, and an inner conductor 211 of the coaxial wire 210 is electrically connected to the metal layer 110 by crossing the slot line 111. Therefore, the signal received by the antenna body 120 can be transmitted to the coupling device 140 through the feed end 122 and the matching device 150, and is conducted to the coaxial wire 210 through the coupling device 140.

It should be noted that the planar antenna 100 can be directly printed on the plate 101 according to any printing technique. During an actual fabrication process, the stepped impedance device 130 of the planar antenna 100 substitutes a through-hole structure of a conventional planar antenna. Therefore, a material cost the planar antenna 100 and a labour cost for assembling the planar antenna 100 can be effectively reduced.

Figure 4:
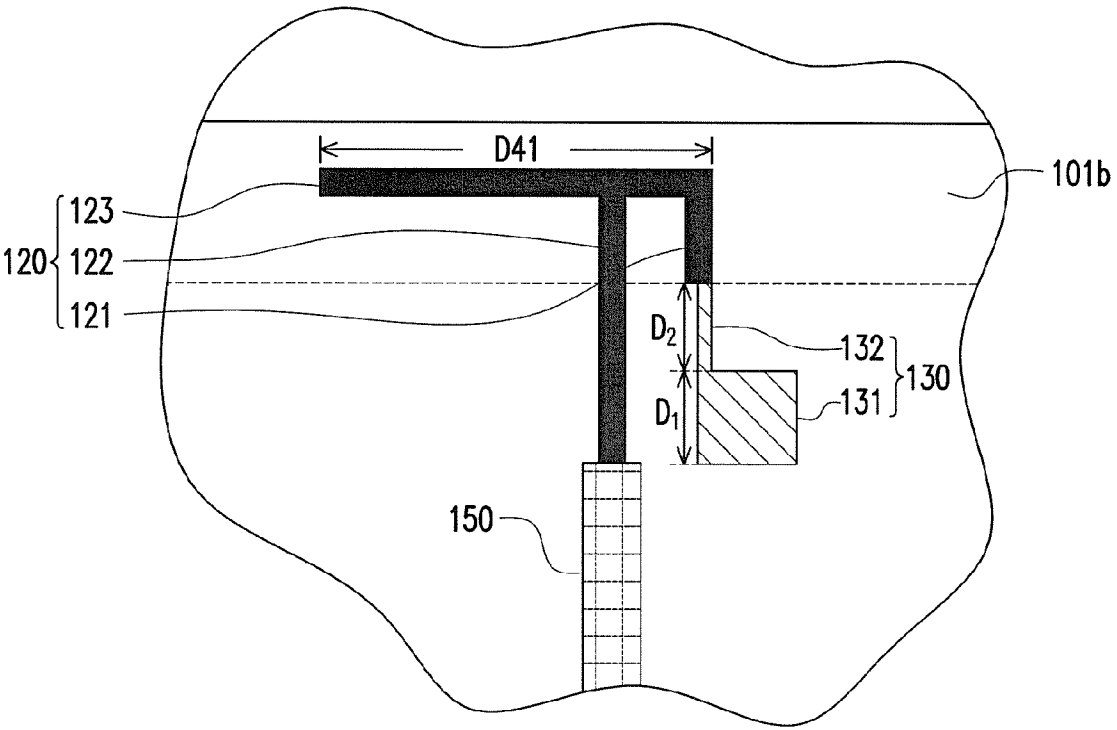
FIG. 4 is a partial amplified diagram of the embodiment of FIG. 1.

FIG. 4 is a partial amplified diagram of the embodiment of FIG. 1. Referring to FIG. 4 to study the antenna body 120 and the stepped impedance device 140 of FIG. 1 in detail. Here, the antenna body 120 is an inverted-F antenna body operated in a single frequency. Namely, a radio frequency band in which the antenna body 120 is operated is used for transmitting signals of a single wavelength.

Here, the antenna body 120 is composed of the ground end 121, the feed end 122 and a excitation part 123. The ground end 121 is electrically connected to one end of the excitation part 123. The feed end 122 is electrically connected between two ends of the excitation part 123. An intersection position of the feed end 122 and the excitation part 123 is determined according to a position between an open end of the excitation part 123 and the ground end 121 that can cause a minimum reflection. Moreover, a length D41 between two ends of the excitation part 123 is closed to a wavelength of the single-frequency signal transmitted by the antenna body 120.

Referring to FIG. 4 again, in the present embodiment, the stepped impedance device 130 is composed of impedance wires 131 and 132. One end of the impedance wire 132 is electrically connected to the ground end 121 of the antenna body 120, and another end of the impedance wire 132 is electrically connected to the impedance wire 131. Regarding a whole operation, to ensure the stepped impedance device 130 generating the transmission zero in the single frequency operated by the antenna body 130, sizes of the impedance wires 131 and 132 have to be in accord with following mathematic equations.

Here, distances between two ends of the impedance wires 131 and 132 are $D_1$ and $D_2$ respectively, and impedances of the impedance wires 131 and 132 are $Z_1$ and $Z_2$ respectively. Wherein, if the operation radio frequency band of the antenna body 120 is used for transmitting the signal with a wavelength of $\lambda$1, r is a positive number and $\Theta_1$ is a phase angle, the mathematic equations (1)-(3) used for determine the sizes of the impedance wires 131 and 132 are as follows:

$$\tan\theta_1 \times \tan(r \cdot \theta_1) = \frac{Z_1}{Z_2} \tag{1}$$

$$D_1 = \theta_1 \times \frac{\lambda_1}{360} \tag{2}$$

$$D_2 = (r \cdot \theta_1) \times \frac{\lambda_1}{360} = r \times D_1 \tag{3}$$

Figure 5:
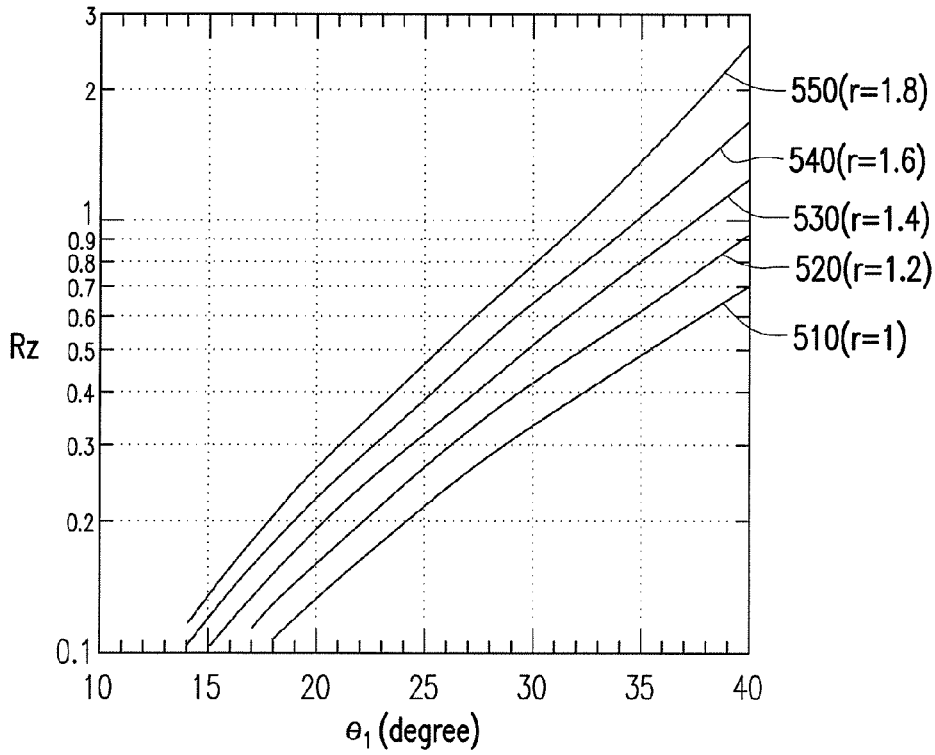
FIG. 5 is a curve diagram corresponding to an equation (1).

If represented by a figure, the mathematic equation (1) is then shown as FIG. 5, wherein an X axis thereof is the phase angles $\Theta_1$, and a Y axis is ratios $R_Z$ between the impedances $Z_1$ and $Z_2$. Referring to FIG. 5, when r=1, relations between the phase angles $\Theta_1$ and the ratios $R_Z$ are shown as a curve 510. Comparatively, when r=1.2, relations between the phase angles $\Theta_1$ and the ratios $R_Z$ are shown as a curve 520. Accordingly, relative relations between curves 530-550 and the value r can be deduced by analogy. Here, a designer can easily design a suitable stepped impedance device 130 according to FIG. 5.

Figure 6:
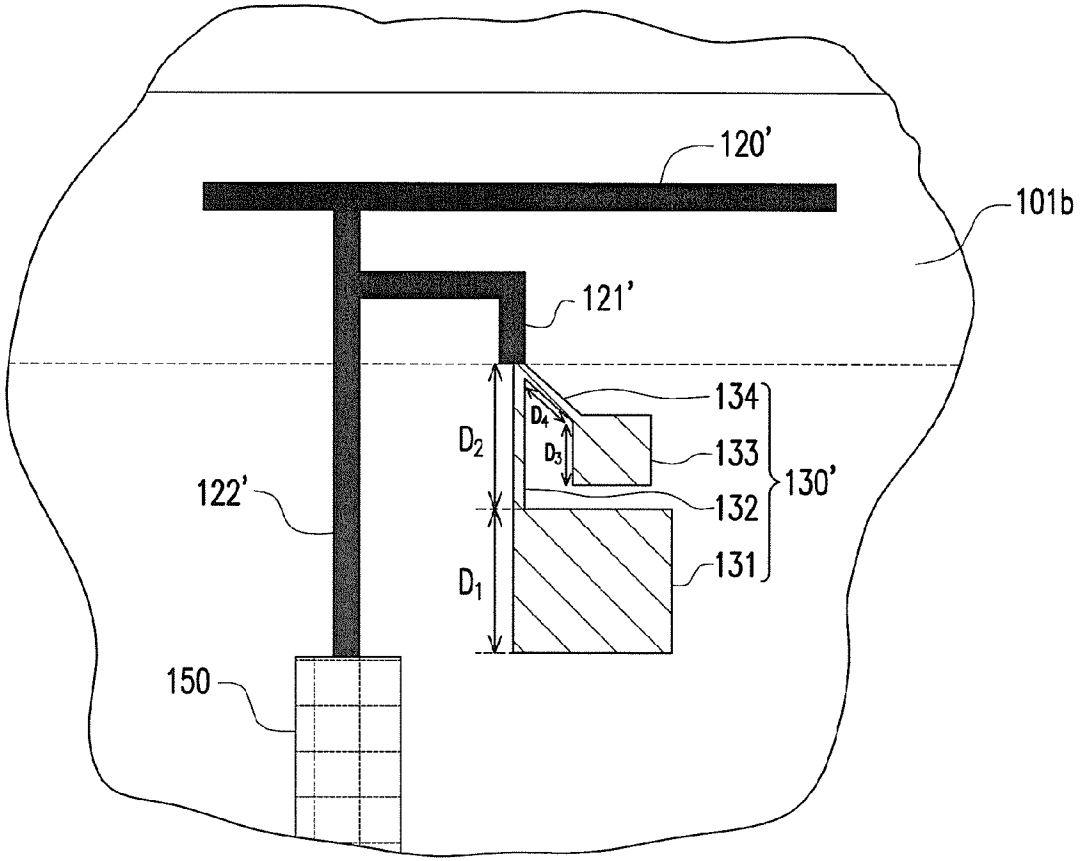
FIG. 6 is a schematic diagram illustrating a structure of an antenna body and a stepped impedance device according to another embodiment of the present invention.

It should be noted that though the inverted-F antenna body 120 operated in the single frequency is taken as an example, in an actual application, the antenna body 120 can also be substituted by an inverted-F antenna body 120' operated in a dual-frequency, as that shown in FIG. 6.

FIG. 6 is a schematic diagram illustrating a structure of an antenna body and a stepped impedance device according to another embodiment of the present invention. Referring to FIG. 6, when the antenna body 120 is substituted by the inverted-F antenna body 120' operated in the dual-frequency, the operation radio frequency band of the antenna body 120' is not only used for transmitting the signal with the wavelength of $\lambda_1$, but is also used for transmitting the signal with a wavelength of $\lambda_2$, wherein $\lambda_1 \neq \lambda_2$. Comparatively, the stepped impedance device 130 that can generate the transmission zero in the single frequency is substituted by a stepped impedance device 130' that can generate the transmission zero in the dual frequency.

Here, the stepped impedance device 130' not only includes the impedance wires 131 and 132 designed according to the wavelength $\lambda_1$, but also includes the impedance wires 133 and 133 designed according to the wavelength $\lambda_2$. Wherein, one end of the impedance wire 134 is electrically connected to a ground terminal 121' of the antenna body 120', and another end of the impedance wire 134 is electrically connected to the impedance wire 133. In the whole operation, to ensure the stepped impedance device 130 generating the transmission zero in another frequency, sizes of the impedance wires 133 and 134 have to be in accord with following mathematic equations.

Here, distances between two ends of the impedance wires 133 and 134 are $D_3$ and $D_4$ respectively, and impedances of the impedance wires 133 and 134 are $Z_3$ and $Z_4$ respectively. Wherein, if s is another positive number and $\Theta_2$ is another phase angle, the mathematic equations (4)-(6) used for determine the sizes of the impedance wires 133 and 134 are as follows:

$$\tan\theta_2 \times \tan(s \cdot \theta_2) = \frac{Z_3}{Z_4} \tag{4}$$

$$D_3 = \theta_2 \times \frac{\lambda_2}{360} \tag{5}$$

$$D_4 = (s \cdot \theta_2) \times \frac{\lambda_2}{360} = s \times D_3 \tag{6}$$

Wherein, those skilled in the art can illustrate the equation (4) into a waveform diagram illustrating relations between ratios of the impedances $Z_3$ and $Z_4$ and the phase angles $\Theta_2$ while referring to FIG. 5.

Figure 7B:
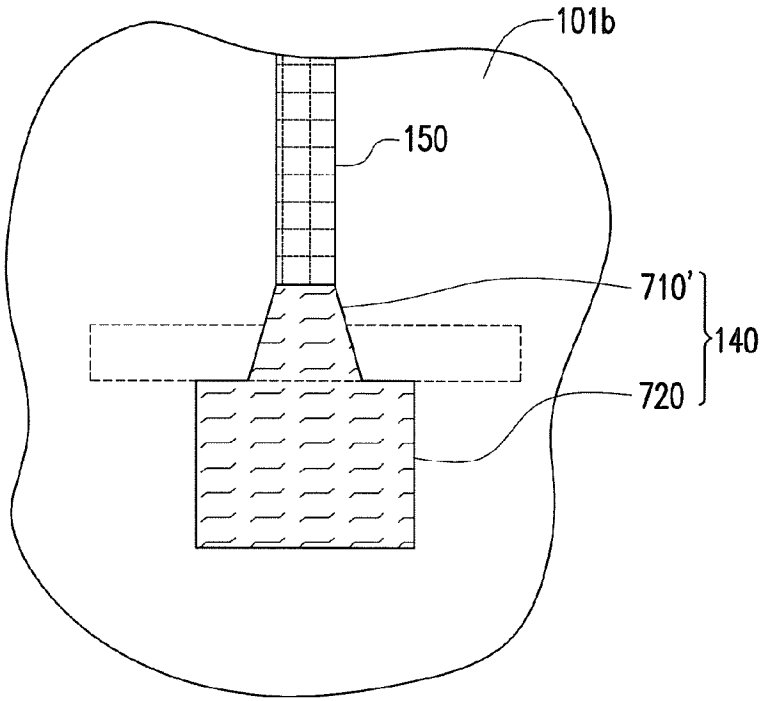
FIG. 7B is a schematic diagram illustrating a structure of a coupling device according to another embodiment of the present invention.
Figure 7A:
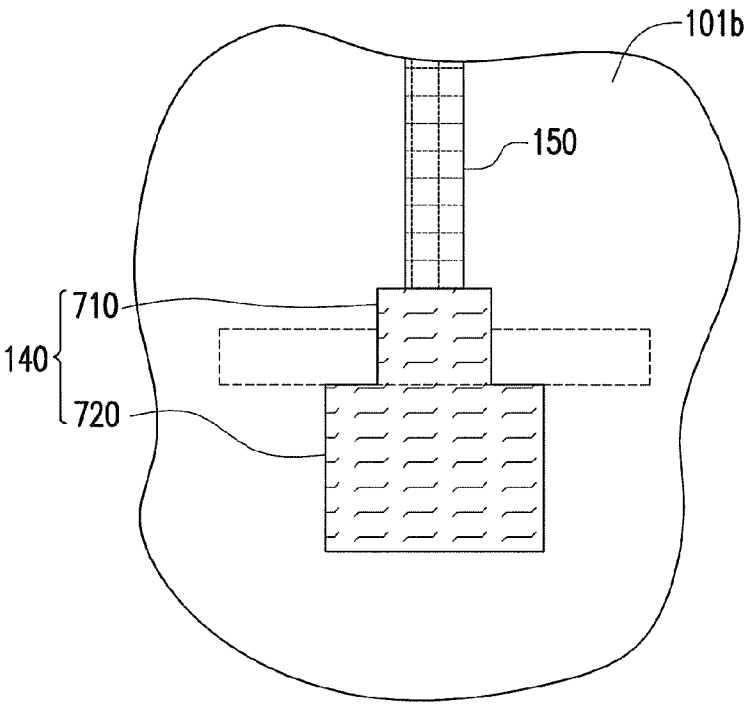
FIG. 7A is another partial amplified diagram of the embodiment of FIG. 1.

FIG. 7A is another partial amplified diagram of the embodiment of FIG. 1. Referring to FIG. 7A, the coupling device 140 of FIG. 1 is further studied. In the present embodiment, the coupling device 140 includes coupling wires 710 and 720. Wherein, the coupling wire 710 has nonadjacent a first side and a second side. Here, the first side of the coupling wire 710 is electrically connected to the matching device 150, and the second side of the coupling wire 710 is electrically connected to the coupling wire 720.

Regarding a whole configuration, a position of the coupling wire 710 is corresponding to the slot line 111 (shown as the dash lines in FIG. 7A). Moreover, in the present embodiment, shapes of the coupling wires 710 and 720 are rectangles. However, in an actual application, the shapes of the coupling wires 710 and 720 can be varied. FIG. 7B is a schematic diagram illustrating a structure of a coupling device according to another embodiment of the present invention. As shown in FIG. 7B, the rectangular coupling wire 710 is changed to be a trapezoid coupling wire 710'. In other words, during the actual design, as long as the position of the coupling wire 710 is corresponding to the slot line 111, the shape of the coupling wire can be arbitrarily changed.

Figure 8A:
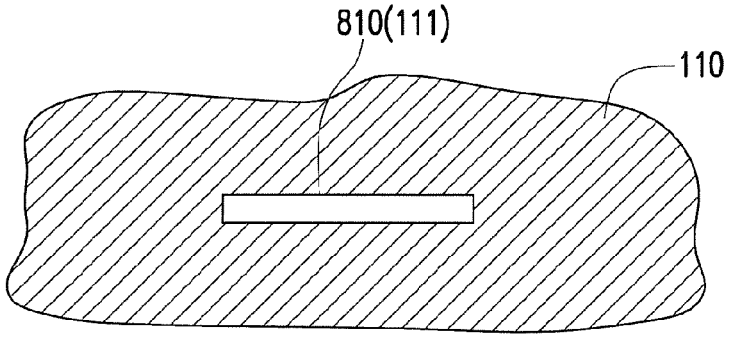
FIG. 8A is another partial amplified diagram of the embodiment of FIG. 1.
Figure 8B:
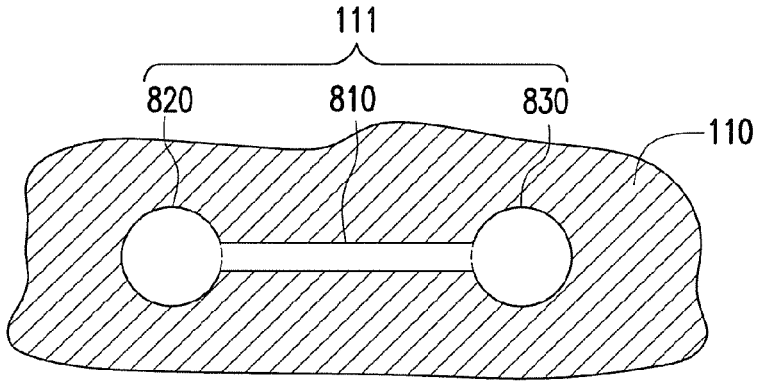
FIG. 8B is a schematic diagram illustrating a structure of a slot line according to another embodiment of the present invention.

FIG. 8A is another partial amplified diagram of the embodiment of FIG. 1. Referring to FIG. 8A, the slot line 111 of FIG. 1 is further studied. In the present embodiment, the slot line 111 is composed of a linear opening 810. Wherein, the linear opening 810 penetrates the metal layer 110 and exposes the first surface 101*a*. However, during the actual application, a shape of the opening can be varied. FIG. 8B is a schematic diagram illustrating a structure of a slot line according to another embodiment of the present invention. As shown in FIG. 8B, the slot line 111 can be composed of the linear opening 810 and different shape of openings.

For example, in FIG. 8B, the slot line 111 includes a linear opening 810, and openings 820 and 830. Here, the linear opening 810, the openings 820 and 830 all penetrate the metal layer 110 to expose the first surface 101*a*. Moreover, the opening 820 is communicated to one side of the linear opening 810, and the opening 830 is communicated to another side of the linear opening 810. It should be noted that in the present embodiment, shapes of the openings 820 and 830 are rounds, and the slot line 111 is dumbbell-shaped. However, in the actual application, the shapes of the openings 820 and 830 can also be triangles. In other words, the shapes of the openings 820 and 830 can be arbitrarily changed according to actual design requirements.

It should be noted that a coupling frequency of the coupling device 140 is mainly determined according to the sizes and shapes of the coupling device 140 and the slot line 111, and a main reason thereof is as follows. Referring to FIG. 3, during a process when the signal received by the antenna body 120 is guided to the coaxial wire 210 through the coupling device 140 and the slot line 111, the coupling device 140 and the metal layer 110 can form an equivalent capacitor, and the inner conductor 211 crossing the slot line 111 is regarded as an equivalent inductor. Here, resistances of the equivalent capacitor and the equivalent inductor are determined according to the sizes and shapes of the coupling device 140 and the slot line 111.

Figure 9A:
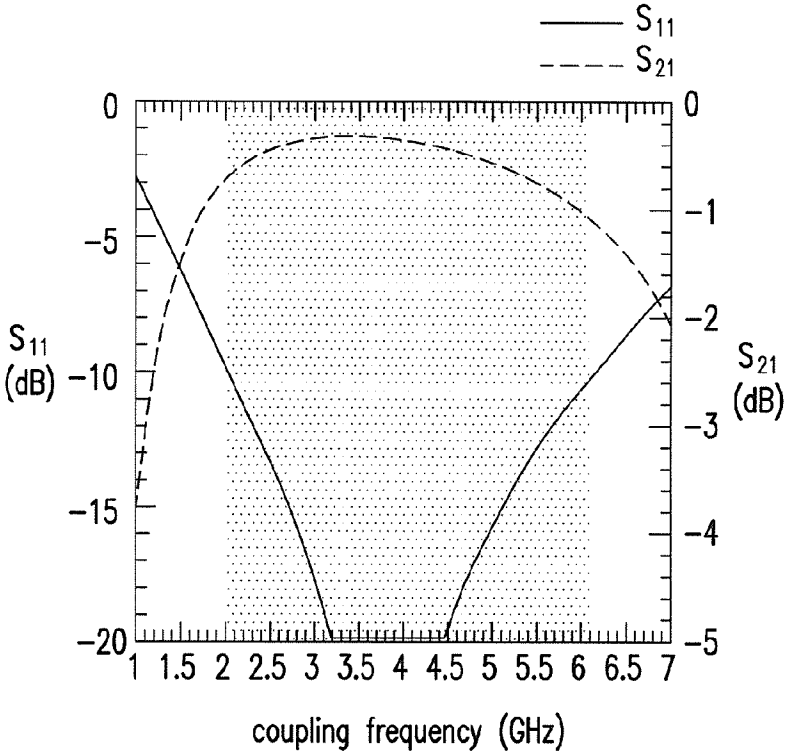
FIG. 9A is a curve diagram illustrating coupling frequencies of a coupling device according to an embodiment of the present invention.
Figure 9B:
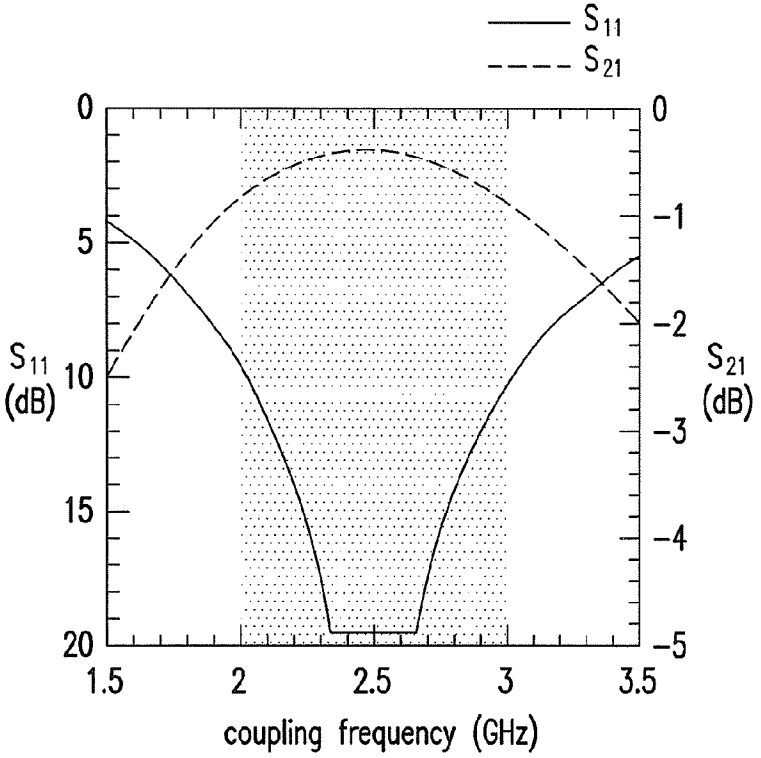
FIG. 9B is a curve diagram illustrating coupling frequencies of a coupling device according to another embodiment of the present invention.

Moreover, FIG. 9A and FIG. 9B are curve diagrams respectively illustrating coupling frequencies of a coupling device according to an embodiment of the present invention. Wherein, when the coupling device 140 of FIG. 7A is used together with the rectangular slot line 111 (shown in FIG. 8A), as shown in FIG. 9A, the coupling frequency of the coupling device 140 is between 2-3 GHz. Now, the coupling device 140 is adapted to a narrowband design. For example, the coupling device 140 can be applied to a WLAN within 2.4 GHz frequency band or a WiMAX within 2-3 GHz frequency band.

Moreover, when the coupling device 140 of FIG. 7B is used together with the trapezoid slot line 111 (shown in FIG. 8B), as shown in FIG. 9B, the coupling frequency of the coupling device 140 is between 2-6 GHz. Now, the coupling device 140 is adapted to a broadband design. For example, the coupling device 140 can be applied to a WLAN and a WiMAX within 2.4 GHz and 5.0 GHz frequency band.

Figure 10:
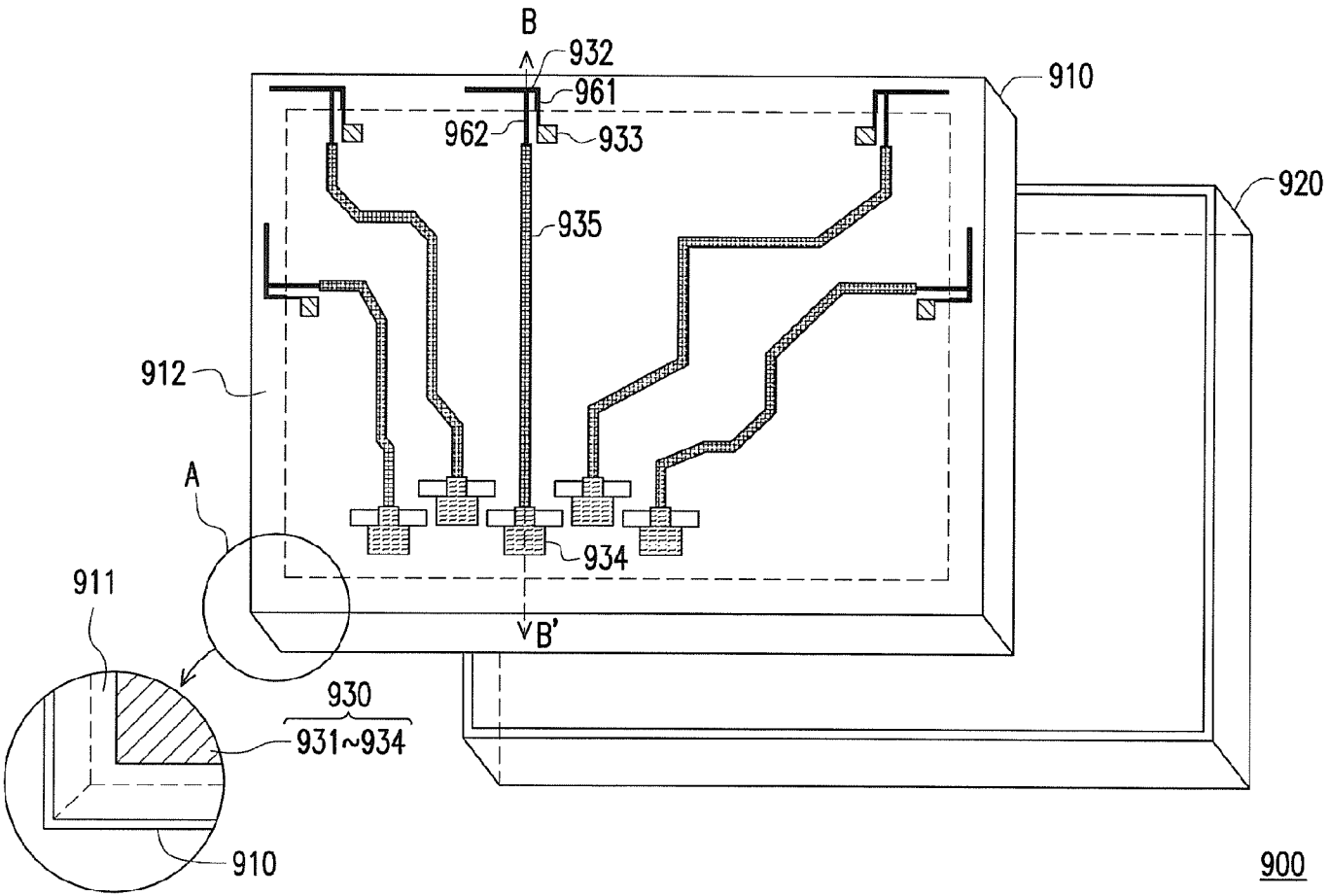
FIG. 10 is an exploded perspective view of a wireless communication apparatus according to an embodiment of the present invention.

FIG. 10 is an exploded perspective view of a wireless communication apparatus according to an embodiment of the present invention. Referring to FIG. 10, the wireless communication apparatus 900 includes a plate 910, a plate 920 and a plurality of planar antennas (for example, planar antennas 930). Wherein, structures of the planar antennas are the same to that of the planar antenna 100 of FIG. 1. For simplicity's sake, the planar antenna 930 is taken as an example. Moreover, an inside view of an area A of the plate 910 is further illustrated in FIG. 10.

Figure 11:
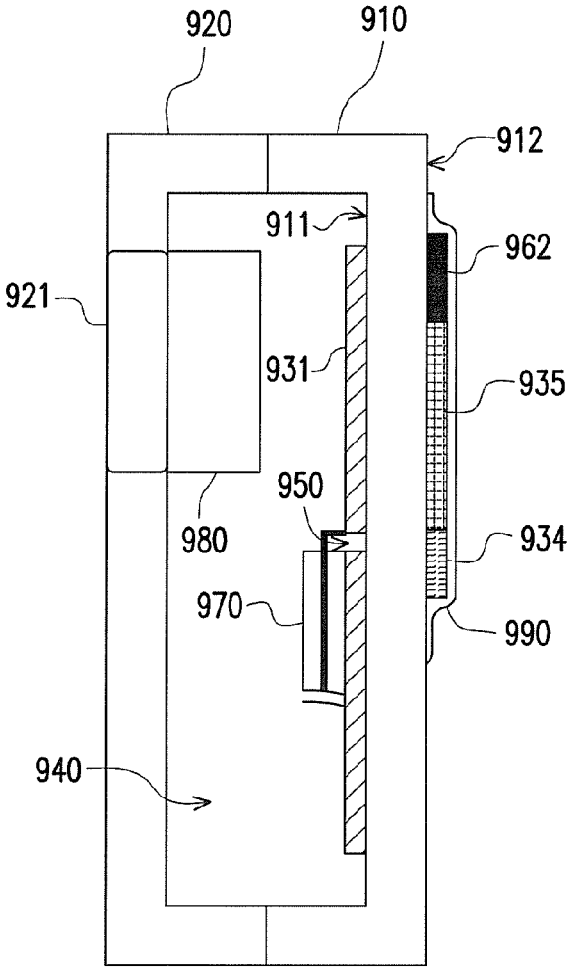
FIG. 11 is a cross-sectional view of a wireless communication apparatus 900 of FIG. 10 cut along a B-B' line.

FIG. 11 is a cross-sectional view of the wireless communication apparatus 900 of FIG. 10 cut along a B-B' line. Referring to FIG. 10 and FIG. 11, the plate 920 has a first surface 911 and a second surface 912. Moreover, the plate 920 is overlapped to the plate 910 to form a chamber to contain an inner circuit of the wireless communication apparatus 900. In other words, during the actual application, the plates 910 and 920 function as a housing of the wireless communication apparatus 900, and the planar antenna 930 is disposed on the housing of the wireless communication apparatus 900.

Further, the planar antenna 930 is disposed on the plate 910, and includes a metal layer 931, an antenna body 932, a stepped impedance device 933, a coupling device 934 and a matching device 935. Wherein, the metal layer 931 is disposed on the first surface 911, and a corresponding position thereof on the second surface 912 is shown as the dash lines. Moreover, the metal layer 931 has a slot line 950 for exposing the first surface 911.

In addition, the antenna body 932 has a ground end 961 and a feed end 962 disposed on the second surface 912. Moreover, the antenna body 932 is corresponding to a surrounding of the metal layer 931 except a partial area of the feed end 962 thereof. The stepped impedance device 933 is disposed on the second surface 912 in an approach of corresponding to the metal layer 931, and is electrically connected to the ground end 961 of the antenna body 932.

Moreover, the coupling device 934 is disposed on the second surface 912, and a partial area of the coupling device 934 is disposed on the second surface 912 in an approach of corresponding to the slot line 950 of the metal layer 931. In addition, the matching device 935 is disposed on the second surface 912 in an approach of corresponding to the metal layer 931, and is electrically connected to the coupling device 934 and the feed end 962 of the antenna body 932. Wherein, the matching device 935 is used for impedance matching between the antenna body 932 and the coupling device 934.

In a whole operation, when the stepped impedance device 933 is operated in a certain radio frequency band, it can have a transmission zero and is regarded as an open circuit. Accordingly, the antenna body 932 can generate a resonance mode in such radio frequency band, and can receive or emit signals of such radio frequency band. Moreover, the signal received by the antenna body 932 can be guided to a coaxial wire (for example, a coaxial wire 970) through the coupling device 934 and the slot line 950. By such means, the inner circuit of the wireless communication apparatus 900 can receives signals from the antenna body 932 through the coaxial wire.

Detail structures of the devices within the planar antenna 930, for example, types, shapes and patterns, etc. of the antenna body 932, the stepped impedance device 933 and the coupling device 934 have been described in the aforementioned embodiments, and therefore detailed descriptions thereof are not repeated.

It should be noted that the wireless communication apparatus 900 further includes a display panel 980 and an insulation layer 990. The first surface 911 of the plate 910 is a part of inner wall of the chamber 940. Moreover, the display panel 980 is disposed in the chamber 940, and is fixed between the metal layer 931 and a transparent block 921 of the plate 920. By such means, the metal layer 931 can suppress an electromagnetic interference. On the other hand, the insulation layer 990 covers the antenna body 932, the stepped impedance device 933, the coupling device 934 and the matching device 935, so as to prevent the planar antenna 930 from damaging during utilization of the wireless communication apparatus 900.

In summary, the stepped impedance device of the present invention is used for substituting a through-hole structure in a conventional planar antenna, and the coupling device is used for coupling the signal received by the planar antenna to the lead wire crossing the slot line of the metal layer. Therefore, the planar antenna of the present invention can be directly printed on the plate, so that a material cost of the planar antenna and a labour cost for assembling the planar antenna can be effectively reduced. Comparatively, when the planar antenna of the present invention is applied to the wireless communication apparatus, the material cost of the wireless communication apparatus and the labour cost for assembling the same are not great increased as a number of the inbuilt antennas is increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar antenna, disposed on a plate having a first surface and a second surface, the planar antenna comprising:
- a metal layer, disposed on the first surface, and having a slot line for exposing the first surface;
- an antenna body, disposed on the second surface, and having a ground end and a feed end;
- a coupling device, disposed on the second surface, and a partial area of the coupling device corresponding to the slot line of the metal layer;
- a matching device, disposed on the second surface and electrically connected to the coupling device and the feed end; and
- a stepped impedance device, disposed on the second surface, and comprises:
  - a first impedance wire, having a first impedance $Z_1$, and a distance between two ends thereof being $D_1$; and
  - a second impedance wire, having one end electrically connected to the first impedance wire and another end electrically connected to the ground end of the antenna body, and having a second impedance $Z_2$, and a distance between two ends thereof being $D_2$, wherein when $\lambda_1$ is a first wavelength, $\theta_1$ is a first phase angle, and r is a positive number, the aforementioned $D_1$, $D_2$, $Z_1$ and $Z_2$ are in accord with following equations:

$$\tan\theta_1\times\tan(r\cdot\theta_1)=Z_1/Z_2, D_1=(\theta_1\times\lambda_1)/360 \text{ and } D_2=r\times D_1.$$

2. The planar antenna as claimed in claim 1, wherein the stepped impedance device further comprises:
- a third impedance wire, having a third impedance $Z_3$, and a distance between two ends thereof being $D_3$; and
- a fourth impedance wire, having one end electrically connected to the third impedance wire and another end electrically connected to the ground end of the antenna body, and having a fourth impedance $Z_4$, and a distance between two ends thereof being $D_4$, wherein when $\lambda_2$ is a second wavelength, $\theta_2$ is a second phase angle, and s is a positive number, the aforementioned $D_3$, $D_4$, $Z_3$ and $Z_4$ are in accord with following equations:

$$\tan\theta_2\times\tan(s\cdot\theta_2)=Z_3/Z_4, D_3=(\theta_2\times\lambda_2)/360 \text{ and } D_4=s\times D_3.$$

3. The planar antenna as claimed in claim 1, wherein the coupling device comprises:
- a first coupling wire, having nonadjacent a first side and a second side, wherein the first side is electrically connected to the feed end of the antenna body, and a position of the first coupling wire is corresponding to the slot line; and
- a second coupling wire, electrically connected to the second side of the first coupling wire.

4. The planar antenna as claimed in claim 3, wherein a shape of the first coupling wire is a rectangle or a trapezoid.

5. The planar antenna as claimed in claim 3, wherein a shape of the second coupling wire is a rectangle or a trapezoid.

6. The planar antenna as claimed in claim 1, wherein the slot line comprises:
- a linear opening, penetrating the metal layer for exposing the first surface.

7. The planar antenna as claimed in claim 6, wherein the slot line further comprises:
- a first opening, penetrating the metal layer, and communicated to a side of the linear opening; and
- a second opening, penetrating the metal layer, and communicated to another side of the linear opening.

8. The planar antenna as claimed in claim 7, wherein shapes of the first opening and the second opening are rounds or triangles.

9. The planar antenna as claimed in claim 1 further comprising:
- a coaxial wire, having an inner conductor and an outer conductor, wherein the outer conductor is electrically connected to the metal layer, and the inner conductor is electrically connected to the metal layer by crossing the slot line.

10. The planar antenna as claimed in claim 1, wherein the antenna body is an inverted-F antenna body.

11. The planar antenna as claimed in claim 1, wherein the plate is a printed circuit board.

12. A wireless communication apparatus, comprising:
- a first plate, having a first surface and a second surface;
- a second plate, the first plate and the second plate forming a chamber to contain an inner circuit of the wireless communication apparatus; and
- a plurality of planar antennas, disposed on the first plate, and each of the planar antennas comprising:
  - a metal layer, disposed on the first surface, and having a slot line for exposing the first surface;
  - an antenna body, disposed on the second surface, and having a ground end and a feed end;
  - a coupling device, disposed on the second surface, and a partial area of the coupling device corresponding to the slot line of the metal layer;
  - a matching device, disposed on the second surface and electrically connected to the coupling device and the feed end of the antenna body; and
  - a stepped impedance device, disposed on the second surface and comprises:
    - a first impedance wire, having a first impedance $Z_1$, and a distance between two ends thereof being $D_1$; and
    - a second impedance wire, having one end electrically connected to the first impedance wire and another end electrically connected to the ground end of the antenna body, and having a second impedance $Z_2$, and a distance between two ends thereof being $D_2$, wherein when $\lambda_1$ is a first wavelength, $\theta_1$ is a first phase angle, and r is a positive number, the aforementioned $D_1$, $D_2$, $Z_1$ and $Z_2$ are in accord with following equations:

$$\tan\theta_1\times\tan(r\cdot\theta_1)=Z_1/Z_2, D_1=(\theta_1\times\lambda_1)/360 \text{ and } D_2=r\times D_1.$$

13. The wireless communication apparatus as claimed in claim 12, wherein the first surface is a part of inner wall of the chamber.

14. The wireless communication apparatus as claimed in claim 13 further comprising:

a display panel, disposed in the chamber, and a position thereof is fixed between the metal layer and a transparent block of the second plate.

15. The wireless communication apparatus as claimed in claim 12 further comprising:

an insulation layer, covering the antenna body, the stepped impedance device and the coupling device.

16. The wireless communication apparatus as claimed in claim 12, wherein the coupling device comprises:

a first coupling wire, having nonadjacent a first side and a second side, wherein the first side is electrically connected to the feed end of the antenna body, and a position of the first coupling wire is corresponding to the slot line; and a second coupling wire, electrically connected to the second side of the first coupling wire.

17. The wireless communication apparatus as claimed in claim 12, wherein the slot line comprises:

a linear opening, penetrating the metal layer for exposing the first surface.

18. The wireless communication apparatus as claimed in claim 12, wherein the slot line further comprises:

a first opening, penetrating the metal layer, and communicated to a side of the linear opening; and a second opening, penetrating the metal layer, and communicated to another side of the linear opening.

* * * * *